United States Patent [19]

Hara

[11] Patent Number: 4,953,463

[45] Date of Patent: Sep. 4, 1990

[54] CLEANING APPARATUS FOR A CYLINDER

[75] Inventor: Akira Hara, Tokyo, Japan

[73] Assignee: B-J Trading Limited, Tokyo, Japan

[21] Appl. No.: 249,955

[22] Filed: Sep. 27, 1988

[30] Foreign Application Priority Data

Nov. 6, 1987 [JP] Japan ..... 62-280645

[51] Int. Cl.[5] ..... B41F 35/00

[52] U.S. Cl. ..... 101/425; 15/256.52

[58] Field of Search ..... 101/425, 424; 15/97 R, 15/256.5, 256.51, 256.52

[56] References Cited

U.S. PATENT DOCUMENTS

| | | | |
|---|---|---|---|
| 4,058,059 | 11/1977 | Moestue | 101/425 |
| 4,135,448 | 6/1979 | Moestue | 101/425 |
| 4,254,709 | 3/1981 | Arnolds | 101/425 |
| 4,311,094 | 1/1982 | Ellison | 101/425 |
| 4,344,361 | 8/1982 | MacPhee et al. | 101/425 |
| 4,393,778 | 7/1983 | Kaneko | 101/425 |
| 4,673,303 | 6/1987 | Sansone et al. | 101/425 |
| 4,757,763 | 7/1988 | MacPhee et al. | 101/425 |
| 4,765,242 | 8/1988 | Oya et al. | 101/425 |

*Primary Examiner*—Eugene H. Eickholt

*Attorney, Agent, or Firm*—Morgan & Finnegan

[57] ABSTRACT

A cylinder cleaning apparatus for cleaning the surface of a cylinder such as an impression cylinder of an offset printing machine having a projection such as paper grippers, by means of a cleaner unit with a cleaning cloth which is selectively held in pressure contact with the surface of the cylinder while the cylinder rotates so that the surface is cleaned, by the relative movement between the cleaner unit and the surface of the cylinder. The apparatus has a projection detector capable of detecting the projection on the cylinder, and a cleaner unit retracting mechanism operative in response to the output from the projection detector such as to retract the cleaner unit away from the surface of the cylinder when the projection is detected by the projection detector means, thereby enabling the cleaner unit to clear the projection.

3 Claims, 8 Drawing Sheets

CLEANING APPARATUS FOR A CYLINDER

BACKGROUND OF THE INVENTION

1. Field of the Invention

The present invention relates to an apparatus for cleaning the outer peripheral surface of a cylinder or a roller such as a cylinder of a printing machine. More particularly, the present invention is concerned with an apparatus suitable for cleaning an impression cylinder of an offset printing machine which has a projection projecting from the outer peripheral surface thereof.

2. Description of the Prior Art

Although the following description is concentrated specifically on an apparatus for cleaning a cylinder of an offset printing machine, it is to be understood that the same printing cylinder cleaning apparatus can be used for cleaning cylinders of other types of printing machine, other various cylinders or rollers.

An offset printing machine usually has three cylinders, namely, a plate cylinder, a blanket cylinder and an impression cylinder. These cylinders are arranged such that their axes extend in parallel with one another and such that they can be brought into mutual contact. A printing plate made of zinc or aluminum is wound on the plate cylinder, while a thin sheet-like blanket such as of rubber is wound on the blanket cylinder. The printing plate has a grained surface and is provided with a water repellent layer carrying an image of characters or a picture. The surface of the printing plate other than portions having images of characters or picture is dampened as water is supplied to the surface of the printing plate by means of dampening device. An oily ink is applied to the surface of the printing plate by means of an inking device. The ink will attach to the portion of the plate surface carrying the image because this area is not dampened, but will be repelled by other portions of the plate surface due to the water content held by the grained surface. The ink thus held on the plate cylinder is transferred to the blanket and is further transferred to a printing paper which passes through the nip between the blanket cylinder and the impression cylinder. This is the principle of offset printing.

The impression cylinder is provided in the outer peripheral surface thereof with a dent which extends in the direction of axis thereof. A plurality of grippers are disposed in this dent so as to partially project from the outer peripheral surface of the impression cylinder. In operation, these grippers grip and feed a printing paper sheet one by one.

The printing machine has a cylinder cleaning apparatus which has a cleaning cloth supply roll and a cleaning cloth take-up roll arranged in a pair on a pair of side plates which are mounted on the frame of the printing machine. A continuous cleaning cloth is wound at its both ends on these rolls and are suitably tensed between these rolls. The cleaning cloth take-up roll is driven by a driving device to rotate at a predetermined speed and intermittently. A stay having a substantially T-shaped cross-section is provided to extend in the direction of axes of these rolls. Both ends of the stay are fixed to the adjacent side plates. The portion of the stay opposing to the blanket cylinder is made hollow, and the surface facing the blanket cylinder is hermetically lined with a pressure pad made of an elastic member. A plenum chamber which is defined by the end of the stay and the pressure pad is communicated with an external air compressor. As the air compressor operates, compressed air is supplied to the plenum chamber so that the pressure pad is expanded, whereby the cleaning cloth sliding on the outer surface of the pressure pad is pressed against the blanket cylinder so as to wipe off contaminant on the blanket wound on the blanket cylinder thereby cleaning the blanket surface.

In the cylinder cleaning apparatus of the kind above described, the cleaning cloth is positioned away from the outer peripheral surface of the blanket cylinder when the cleaning is not conducted, and is pressed onto the surface of the blanket cylinder in response to a cleaning start signal. The cleaning cloth is held in contact with the blanket cylinder while the blanket cylinder rotates a number which is large enough to ensure sufficient cleaning of the cylinder surface. This cleaning apparatus, however, cannot be used in the cleaning of the impression cylinder, because of the presence of the grippers which partially project beyond the surface of the impression cylinder. Namely, the cleaning cloth interfere with the grippers each time the grippers are brought to the position of the cleaning cloth so as to cause the pressure pad and the grippers to be damaged. For these reasons, the cleaning of the impression cylinder requires that the printing machine is stopped to enable the cylinder surface to be manually cleaned by means of, for example, a waste cloth impregnated with a cleaning oil. Thus, the cleaning of cylinder surfaces with projections, which rely upon manual work, requires much time and labor.

SUMMARY OF THE INVENTION

Accordingly, an object of the present invention is to provide a cleaning apparatus for cleaning a cylinder having a radial projection, capable of automatically detecting the position of the projection and temporarily retracting the cleaning cloth away from the cylinder surface so as to enable the cleaning cloth to clear the projection.

To this end, according to one aspect of the present invention, there is provided an apparatus for cleaning a surface of a cylinder having a projection by means of a cleaner unit which is selectively held in pressure contact with the surface of the cylinder while the cylinder rotates so that the surface is cleaned by the relative movement between the cleaner unit and the surface of the cylinder, the apparatus comprising: a projection detector means capable of detecting the projection on the cylinder; and a cleaner unit retracting means operative in response to the output from the projection detector means such as to retract the cleaner unit away from the surface of the cylinder when the projection is detected by the projection detector means, thereby enabling the cleaner unit to clear the projection.

According to another aspect of the invention, there is provided an apparatus for cleaning the surface of a cylinder having a projection by means of a cleaner unit which is selectively held in pressure contact with the surface of the cylinder while the cylinder rotates so that the surface is cleaned by the relative movement between the cleaner unit and the surface of the cylinder, the apparatus comprising: plate cam means capable of rotating in synchronization with the rotation of the cylinder and having a cam surface positioned such that its rotational phase corresponds to that of the projection of the cylinder: and cam follower means integrally attached to the cleaner unit and adapted to be pressed onto the cam surface, the cam follower means being capable of cooperating with the plate cam means so as to retract the cleaner unit away from the surface of the cylinder thereby enabling the cleaner unit to clear the projection of the cylinder, the cylinder having a cylinder shaft rotatably supported on frame members of a machine.

According to still another aspect of the invention, there is provided an apparatus for cleaning the surface of a cylinder having a projection by means of a cleaner unit which is selectively held in pressure contact with the surface of the cylinder while the cylinder rotates so that the surface is cleaned by the relative movement between the cleaner unit and the surface of the cylinder, the apparatus comprising: plate cam means capable of rotating in synchronization with the rotation of the cylinder and having a cam surface positioned such that its rotational phase corresponds to that of the projection of the cylinder; and a link mechanism provided with a cam follower and connected to the cleaner unit, the cam follower being adapted to make pressure contact with the cam surface, the link mechanism being capable of cooperating with the plate cam means so as to retract the cleaner unit away from the surface of the cylinder thereby enabling the cleaner unit to clear the projection of the cylinder, the cylinder having a cylinder shaft rotatably supported on frame members of a machine.

According to the present invention, the cleaner unit of the cleaning apparatus is retracted away from the surface of the cylinder in response to a detection signal from the projection detector means, immediately before the projection on the cylinder is brought to a position where it is contactable with the cleaner unit, whereby any interference between the projection and the cleaner unit is avoided.

In another aspect, the cleaner unit is retracted away from the cylinder surface immediately before the projection on the cylinder is brought to a position where it is contactable with the cleaner unit, by the cooperation between the cam follower integrally attached to the cleaner unit and the plate cam means.

In still another aspect, the cleaner unit is retracted away from the cylinder surface immediately before the projection on the cylinder is brought to a position where it is contactable with the cleaner unit, by the cooperation between the link mechanism with cam follower and the plate cam means contacted by the cam follower.

The above and other objects, features and advantages of the present invention will become clear from the following description of the preferred embodiments when the same is read in conjunction with the accompanying drawings.

DETAILED DESCRIPTION OF THE PREFERRED EMBODIMENTS

Figure 12:
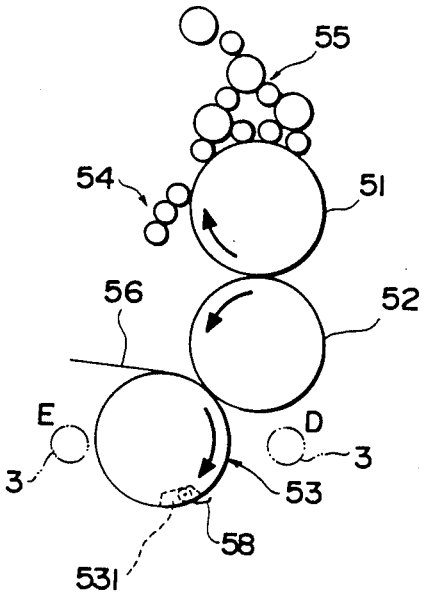
Fig. 12 PRIOR ART
FIG. 12 is a schematic side elevational view of an offset printing machine.

As shown in FIG. 12, a typical offset printing machine has three cylinders, namely, a plate cylinder 51, a blanket cylinder 52 and an impression cylinder 53. These cylinders are arranged such that their axes extend in parallel with one another and such that they can be brought into mutual contact. A printing plate (not shown) made of zinc or aluminum is wound on the plate cylinder 51, while a sheet-like blanket 521 such as of rubber (see FIG. 14) is wound on the blanket cylinder 52. The printing plate has a grained surface and is provided with a water repellent layer carrying an image of characters or a picture. The surface of the printing plate other than portions having images of characters or picture is dampened as water is supplied to the surface of the printing plate by means of dampening device 54. An oily ink is applied to the surface of the printing plate by means of an inking device 55. The ink will attach to the portion of the plate surface carrying the image because this area is not dampened, but will be repelled by other portions of the plate surface due to the water content held by the grained surface. The ink thus held on the plate cylinder is transferred to the blanket 521 and is further transferred to a printing paper 56 which passes through the nip between the blanket cylinder 52 and the impression cylinder 53.

The impression cylinder 53 is provided in the outer peripheral surface thereof with a dent 531 which extends in the direction of axis thereof. A plurality of grippers 58 are disposed in this dent 531 so as to partially project from the outer peripheral surface of the impression cylinder 53. In operation, these grippers 58 grip and feed a printing paper sheet 56 one by one.

Figure 13:
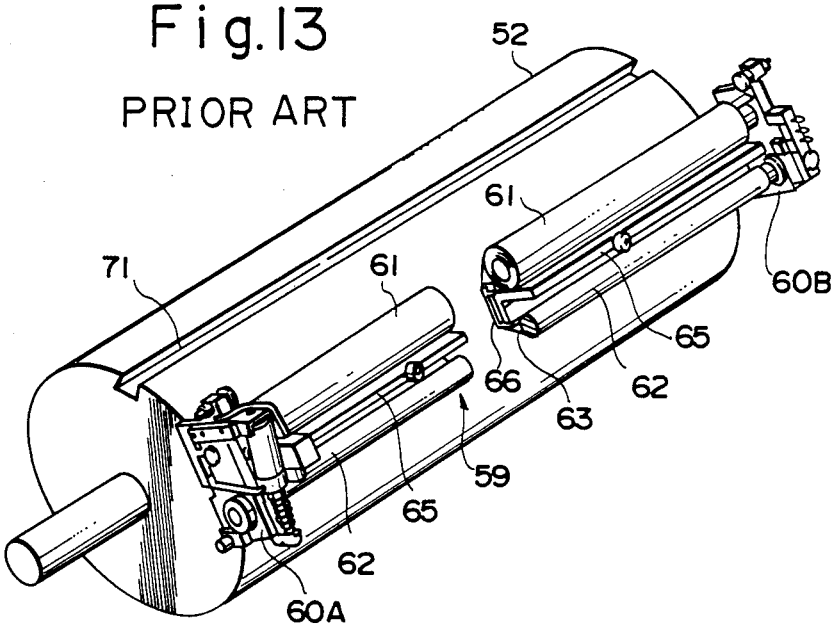
Fig.13 PRIOR ART
FIG. 13 is an illustration of a known blanket cylinder cleaning apparatus.
Figure 14:
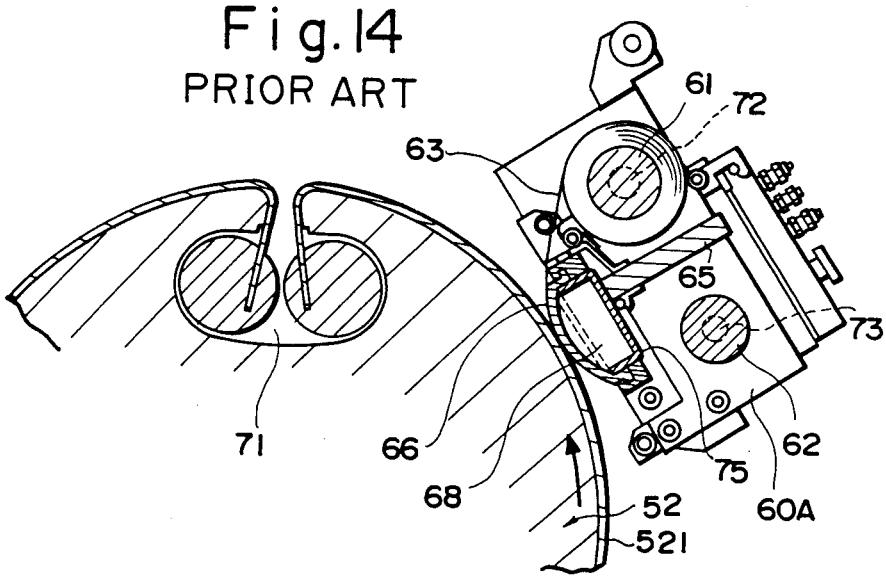
Fig.14 PRIOR ART
FIG. 14 is a sectional view of the known apparatus shown in FIG. 13.

FIGS. 13 and 14 show a known blanket cylinder cleaning apparatus 59. The cleaning apparatus 59 has a cleaning cloth supply roll 61 and a cleaning cloth take-up roll 62 arranged in a pair on a pair of side plates 60A, 60B which are mounted on the frames of the printing machine. These rolls 61 and 62 are disposed in parallel with the axis of the blanket cylinder 52 and are rotatably mounted. A continuous cleaning cloth 63 is wound at its both ends on these rolls 61, 62 and are suitably tensed between these rolls. The cleaning cloth take-up roll 62 is driven by a driving device (not shown) to rotate at a predetermined speed and intermittently. A stay 65 having a substantially T-shaped cross-section is provided to extend in the direction of axes of these rolls 61, 62. Both ends of the stay are fixed to the adjacent side plates 60A, 60B. The portion of the stay 65 opposing to the blanket cylinder 52 is made hollow, and the surface facing the blanket cylinder 52 is hermetically lined with a pressure pad 66 made of an elastic member. A plenum chamber 68 which is defined by the end of the stay 65 and the pressure pad 66 is communicated with an external air compressor (not shown). As the air compressor operates, compressed air is supplied to the plenum chamber 68 so that the pressure pad 66 is expanded, whereby the cleaning cloth 63 sliding on the outer surface of the pressure pad 66 is pressed against the blanket cylinder 52 so as to wipe off contaminant on the blanket 521 wound on the blanket cylinder 52 thereby cleaning the blanket surface.

In FIGS. 13 and 14, a reference numeral 71 denotes a dent for rolling the blanket 521 thereinto, 72 denotes a cloth supply roller shaft, 73 denotes a cloth take-up roller shaft and 75 denotes a pressure pad mounting member.

In the cylinder cleaning apparatus of the kind above described, the cleaning cloth 63 is positioned away from the outer peripheral surface of the blanket cylinder 52 when the cleaning is not conducted, and is pressed onto the surface of the blanket cylinder 52 in response to a cleaning start signal. The cleaning cloth 63 is held in contact with the blanket cylinder 52 while the blanket cylinder rotates a number which is large enough to ensure sufficient cleaning of the cylinder surface. This cleaning apparatus, however, cannot be used in the cleaning of a cylinder which has a projection projecting from the surface thereof. Namely, the cleaning of the impression cylinder essentially relies upon manual work, requiring much time and labor.

This problem, however, can be overcome by the present invention as will be understood from the following description of the preferred embodiments.

Figure 1:
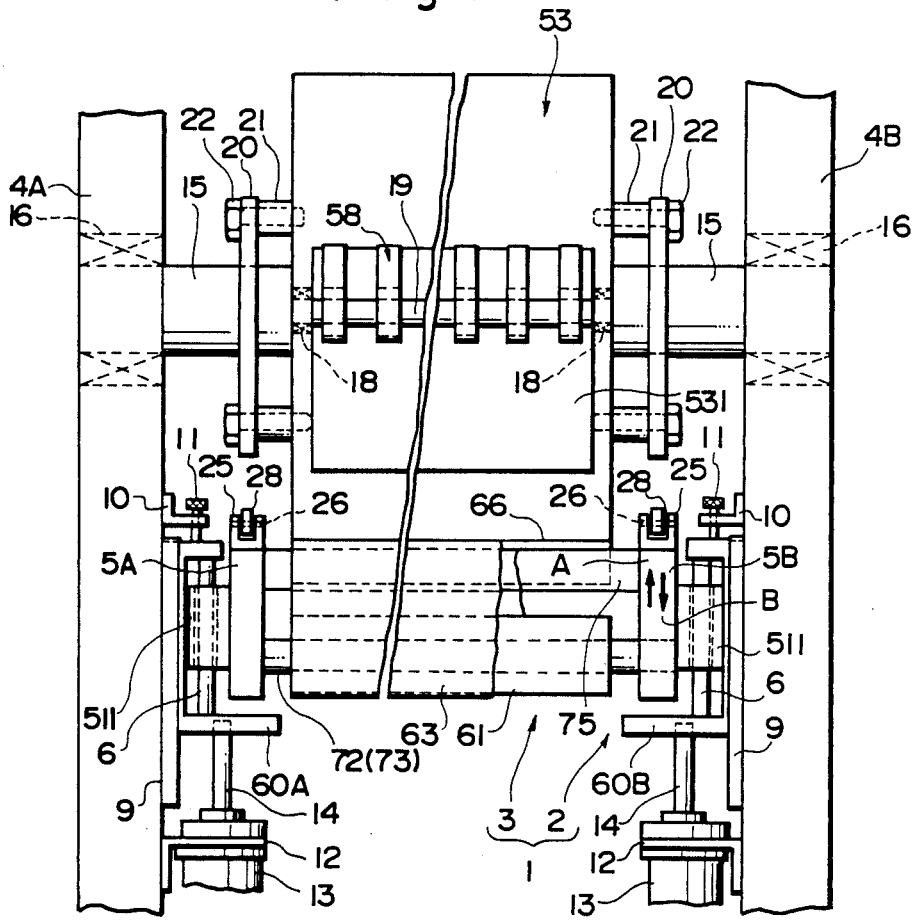
FIG. 1 is a schematic front elevational view of a first embodiment of the cylinder cleaning apparatus of the present invention.
Figure 2:
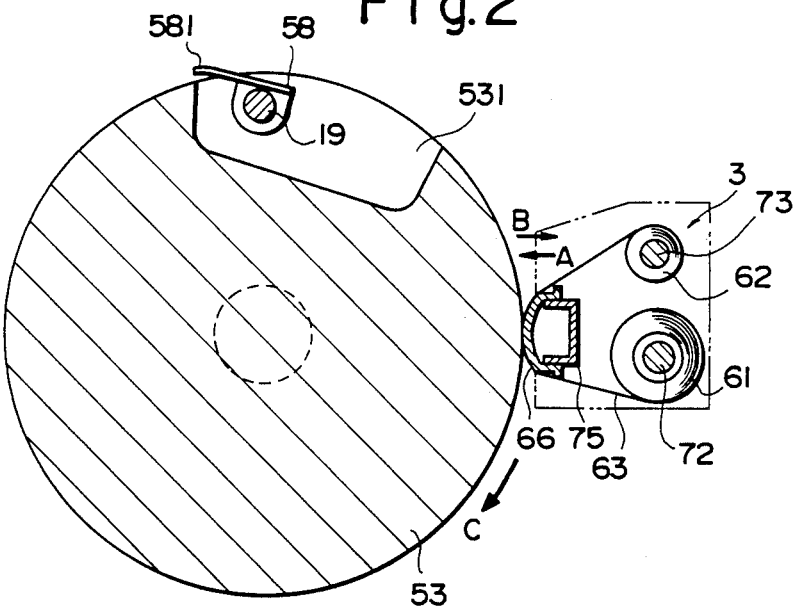
FIG. 2 is a side elevational view showing the relationship between the impression cylinder of a printing machine and a cleaning cloth of the embodiment shown in FIG. 1 during cleaning operation.
Figure 3:
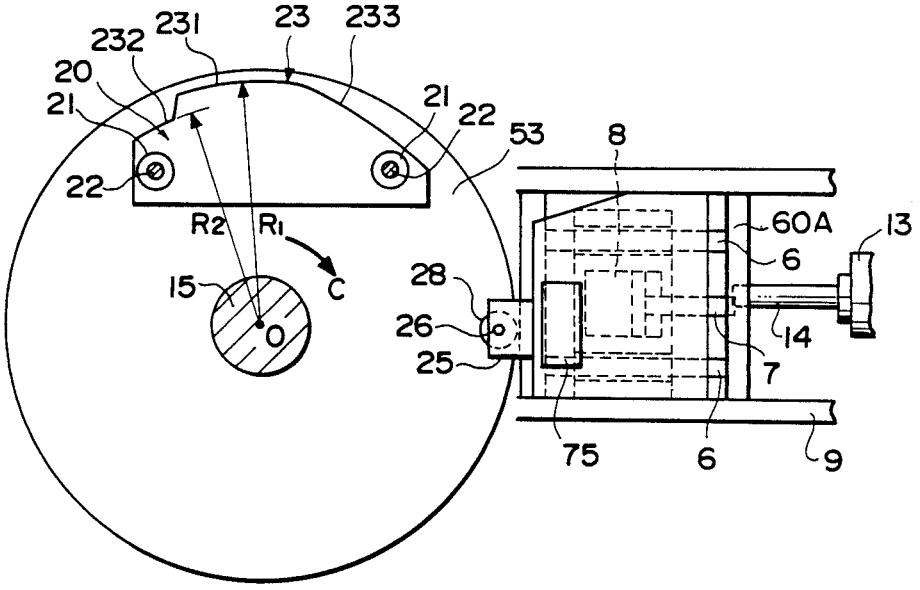
FIG. 3 is a schematic side elevational view of a cleaner unit retracting mechanism of the embodiment shown in FIG. 1 during cleaning operation.

FIGS. 1 to 3 show a first embodiment of the present invention. In these Figures, the same reference numerals are used to denote the same parts or members as those used in FIGS. 12 to 14.

An apparatus 1 for cleaning the impression cylinder of an offset printing machine has a cleaner unit retracting mechanism 2. A cleaner unit 3 having a cleaning cloth 63 is mounted on frames 4A, 4B of the offset printing machine so as to be able to move into and out of contact with the surface of the impression cylinder 53, as will be detailed hereinbelow.

A cloth supply roll shaft 72, cloth take-up roll shaft 73 and the pressure pad mounting member 75 are fixed at their both ends to slidable members 5A and 5B. The slidable members 5A and 5B are provided with projections 511 formed on the side surfaces thereof and fitting on guide shafts 6 which are fixed to the side plates 60A and 60B so as to extend orthogonally to the axis of the impression cylinder 53. The slidable members 5A and 5B are slidable in the directions of the arrows A and B by means of pneumatic cylinders 8 which have rods 7 fixed to the side plates 60A, 60B. The pneumatic cylinders 8 constitute first pneumatic cylinders. The side plates 60A, 60B are slidably held by guide members 9 which are fixed to the frames 4A, 4B and are slidable along the guide members 9 in the same direction as the sliding movement of the slidable members 5A, 5B. The stroke of the sliding motion in the direction of the arrow A is limited by stopper screws 11 screwed to stopper brackets 10 fixed to the frames 4A and 4B. Pneumatic cylinders 13 are mounted on brackets 12 which in turn are fixed to the frames 4A, 4B. The pneumatic cylinders 13 have rods 14 which are fixed to the side plates 60A, 60B. The pneumatic cylinders 13 constitute second pneumatic cylinders.

An impression cylinder shaft 15 is rotatably supported at its both ends on the frames 4A, 4B by bearings 16. A dent 531 is formed in the impression cylinder 53 and a plurality of grippers 58 are disposed in the dent 531. More specifically, the grippers 58 are fixed to a gripper shaft 19 which is fixed at its both ends to the impression cylinder 53 such that the ends 581 of the gripper 58 project from the outer peripheral surface of the impression cylinder 53. On each side of the impression cylinder 53 is disposed a plate cam 20 which is fixed to the impression cylinder 53 by bolts 22 through spacers 21, so as to cross the axis of the impression cylinder 53. The plate cam 20 serves as a projection detecting means. The plate cams 20 rotate in synchronization with the impression cylinder 53. Each plate cam 20 has cam contour 23 constituted by a crest 231 and a valley 232. The crest 231 is positioned in phase alignment with the gripper 58 and is constituted by an arc of a radius $R_1$ centered at the axis 0 of the impression cylinder 53. On the other hand, the valley 232 is constituted by an arc having a radius $R_2$ centered at the axis 0 of the impression cylinder 53. The valley 232 is disposed on the trailing side of the crest 231 as viewed in the direction of rotation of the impression cylinder 53. A tapered portion 233 defining a tapered surface of a gentle gradient is provided on the leading side of the crest 231. The cam surface of each cam contour is contacted by a cam follower 28 rotatably carried by a pin 26 on the bracket 25 which is integrally fixed to the top surface of the slidable member 5A, 5B. When the cam follower 28 is contacted by the valley 232, the cleaning cloth 63 is held in pressure contact with the outer peripheral surface of the impression cylinder 53, whereas, when the cam follower 28 contacts the crest 231, the cleaning cloth 63 is retracted from the outer peripheral surface of the impression cylinder 53 to a position which is radially outwardly spaced from the ends of the grippers 58.

The operation of the first embodiment will be described hereinunder.

In the first embodiment, the cleaner unit 3 of the cleaning apparatus is disposed at a position D shown by imaginary line in FIG. 12, so that it may not be interfere with the trailing end of the print paper 56 fed by the grippers 58 when the cleaning is not conducted.

In order to switch the state of the cleaning apparatus from the inoperative or non-cleaning state shown in FIG. 1 to the operative or cleaning state shown in FIG. 2, the second pneumatic cylinders 13 are actuated so as to cause the side plates 60A and 60B to slide in the direction of the arrow A along the guide members 9. As a result, the cam followers 28 are moved to positions where they are just going to contact the plate cams 20 and where the cleaner unit 3 is just going to enter the path of movement of the ends 581 of the grippers 58. As the first pneumatic cylinders 8 are activated in this state, the slidable members 5A and 5B are moved in the direction of the arrow A along the guide shafts 6 into contact with the stoppers 11, whereby the cam followers 28 reach the respective positions where they are materially in pressure contact with the valleys 232 of the plate cams 20. As a result, the cleaning cloth 63 is brought into pressure contact with the outer peripheral surface of the impression cylinder 53 by the pneumatic pressure acting in the first pneumatic cylinders 6 and the pressure pad 66, whereby the surface of the impression cylinder 53 rotates in the direction of the arrow C and is cleaned.

Meanwhile, the cam followers 28 contact the plate cams 20 which rotate together with the impression cylinder 53 and slide on the tapered surfaces 233 of the plate cams 20 so as to reach the crests 231 of the respective plate cams 20. In consequence, the cleaner unit 3 is moved outside the path of movement of the ends 581 of the grippers 58. It is thus possible to prevent the ends 581 of the grippers 58 from interfering with the cleaning unit 3, so that any accident due to interference such as breakdown of the grippers 58 and/or the cleaning unit 3 is avoided.

For switching the state of the cleaning apparatus from the operative or cleaning state to the inoperative or non-cleaning state, the first and the second pneumatic cylinders 8, 13 are operated in the reverse sequence to that described above.

Figure 4:
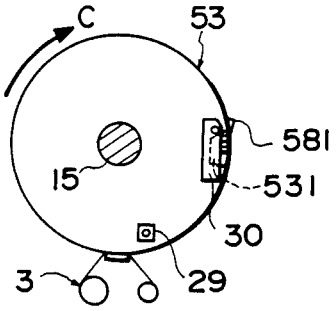
FIGS. 4 to 7 are illustrations of different example of projection detectors in accordance with the present invention.

FIGS. 4 to 7 show a different example of the projection detector. More specifically, the projection detector shown in FIG. 4 is constituted by a proximity sensor 29 and the sensor dog 30. The proximity sensor 29 is fixed to each of the side plates 60A and 60B in the vicinity of the cleaner unit 3 and on the leading side as viewed in the direction of rotation of the impression cylinder 53. The sensor dog 30 is fixed to the impression cylinder 53 in the vicinity of the end 581 of the gripper 58, on the trailing side thereof and at the position which the sensor dog 30 can face the proximity sensor 29. In operation, when the sensor dogs 30 rotating in the direction of arrow C reach positions where they face the proximity sensor 29, the first pneumatic cylinders 8 are operated in response to the detection signals from the proximity sensors 29, so that the cleaner unit 3 is moved in the direction of the arrow B away from the outer peripheral surface of the impression cylinder 53. As the sensor dogs 30 move away from the proximity sensor 29, the first pneumatic cylinders 8 operate in the reverse sequence so that the cleaner unit 3 is brought once again into pressure contact with the outer peripheral surface of the impression cylinder 53, thereby to conduct the cleaning.

Figure 5:
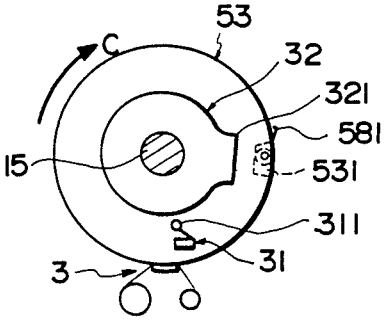

FIG. 5 shows a different example of the projection sensor. This projection sensor is composed of a limit switch 31 and a cam 32. The limit switch 31 is fixed to each of the side plates 60A and 60B in the vicinity of the cleaner unit 3 and on the leading side. Each cam 32 is fixed to the impression cylinder shaft 15 in such a manner that a protrusion 321 formed on outer peripheral surface of the cam 32 is positioned on the trailing side so as to oppose the end 581 of the corresponding gripper 58 at a position where it can contact with the contact point 311 of the limit switch.

In operation, when a contact point 311 of the limit switch 31 is contacted by a protrusion 321 on the cam 32, the limit switch 31 produces a detection signal which serves, through the same procedure as that explained before in connection with FIG. 4, to drive the cleaner unit 3 away from the outer peripheral surface of the impression cylinder 53. When the contact 311 of the limit switch 32 is left by the protrusion 321, the cleaning operation is conducted by the same procedure as that described before in connection with FIG. 4.

Figure 6:
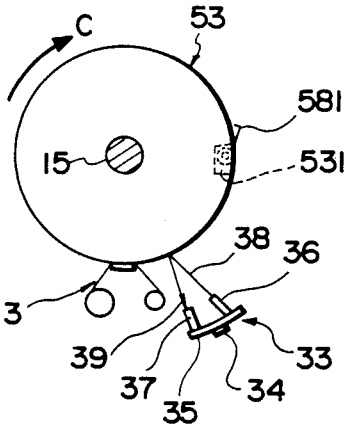
Figure 7:
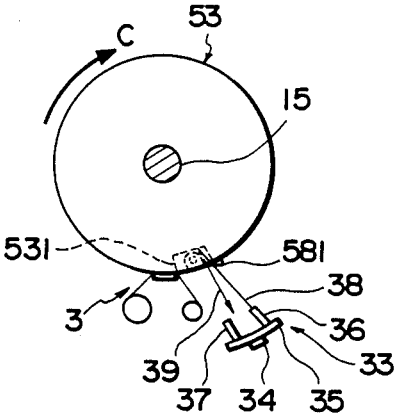

FIGS. 6 and 7 show a different example of the projection detector which makes use of a photo-sensor 33. The photo-sensor 33 is disposed in the vicinity of the cleaner unit 3 on the leading side thereof as viewed in the direction of rotation of the impression cylinder 53. The projection detector of this example is composed of a mounting plate 35 fixed to the end of a photo-device mounting rod 34 and a light emitting portion 36 and a light-receiving portion 37 which are mounted on the mounting plate 35. As will be seen from FIG. 6, the projection detector is arranged such that the light beam 38 projected from the light-emitting portion 36 onto the outer peripheral surface of the impression cylinder 53 is received by the light-receiving portion 37. FIG. 7 shows the state in which the ends 581 of the grippers 58 have been brought to positions near the cleaning unit 3. In this state, the light receiving portion 37 cannot receive the light 39 reflected from the bottom of the dent 531. In consequence, the light-receiving portion 37 produces a signal which serves to drive the cleaner unit 3 away from the outer peripheral surface of the impression cylinder 53. When the dent 531 passes the circumferential position corresponding to the cleaning unit 3, the operation is conducted in the same way as that explained before in connection with FIG. 4, thereby to clean the surface of the impression cylinder 53. Obviously, the pneumatic cylinders used in the first embodiment may be substituted by electromagnetic actuators.

Figure 8:
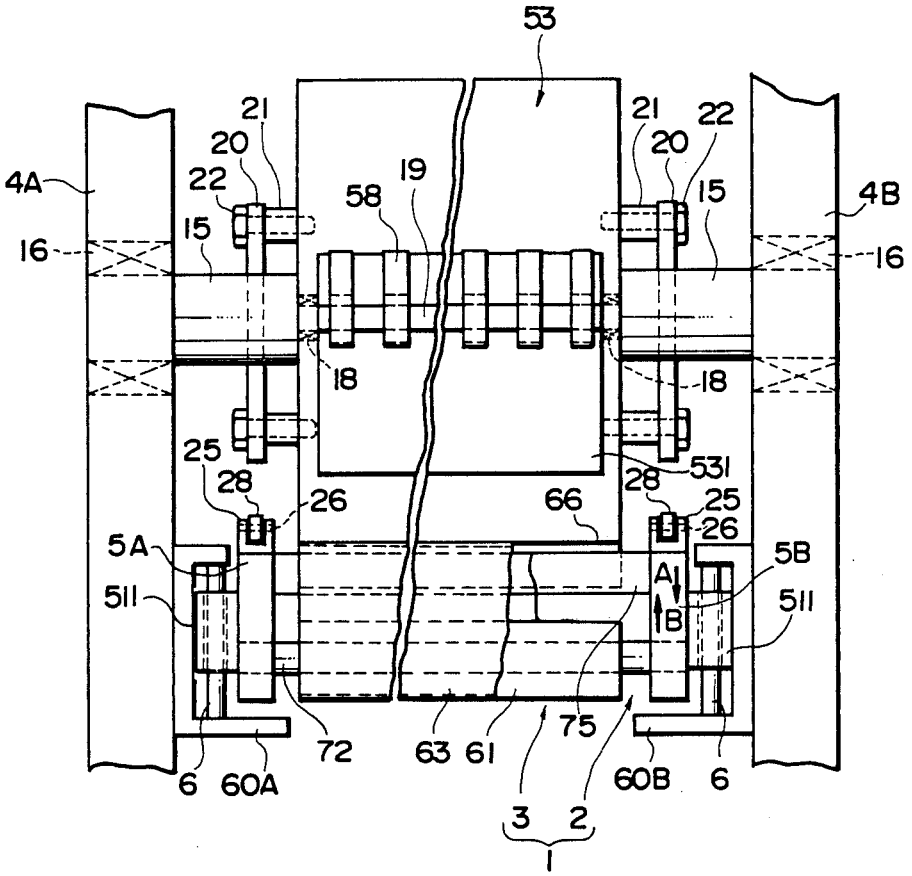
FIG. 8 is a schematic front elevational view of a second embodiment of the cylinder cleaning apparatus of the present invention.

FIG. 8 shows a second embodiment of the present invention. In this embodiment, the cleaner unit 3 is disposed at a position E shown by imaginary line in FIG. 12, that is, a position on the opposite side of the impression cylinder 53 to the cleaner unit of that in the first embodiment. In this embodiment, the cleaner unit 3 can be disposed in the close proximity of the ends 581 of the grippers 58 because there is no risk for the cleaner unit 3 to be contacted by the trailing end of the print paper 56 which is gripped by the grippers 58 and fed in accordance with the rotation of the impression cylinder 53. In this embodiment, therefore, the second pneumatic cylinder 13 and the guide member 9 used in the first embodiment may be dispensed with. Thus, the arrangement may be such that the side plates 60A, 60B are fixed to the frames 4A, 4B of the printing machine, and that the first pneumatic cylinders 8 are disposed in the same way as that in the first embodiment.

Although in the described embodiment the cleaner unit 3 incorporates a cleaning cloth 63, this is only illustrative and the arrangement may be such that a brush or a rubber roller is used in place of the cleaning cloth 63. It is also possible to substitute a spring mechanisms in place of the first pneumatic cylinders 8.

Figure 9:
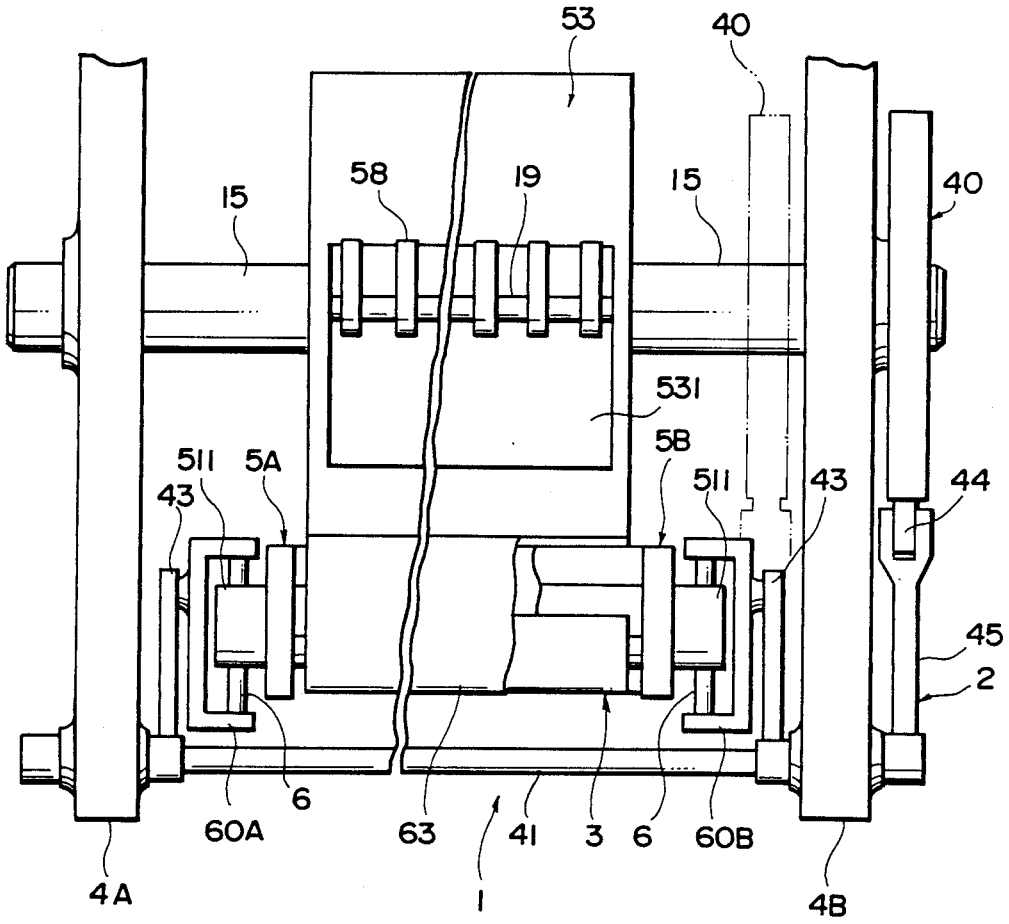
FIG. 9 is a schematic front elevational view of a third embodiment of the cylinder cleaning apparatus of the present invention.
Figure 10:
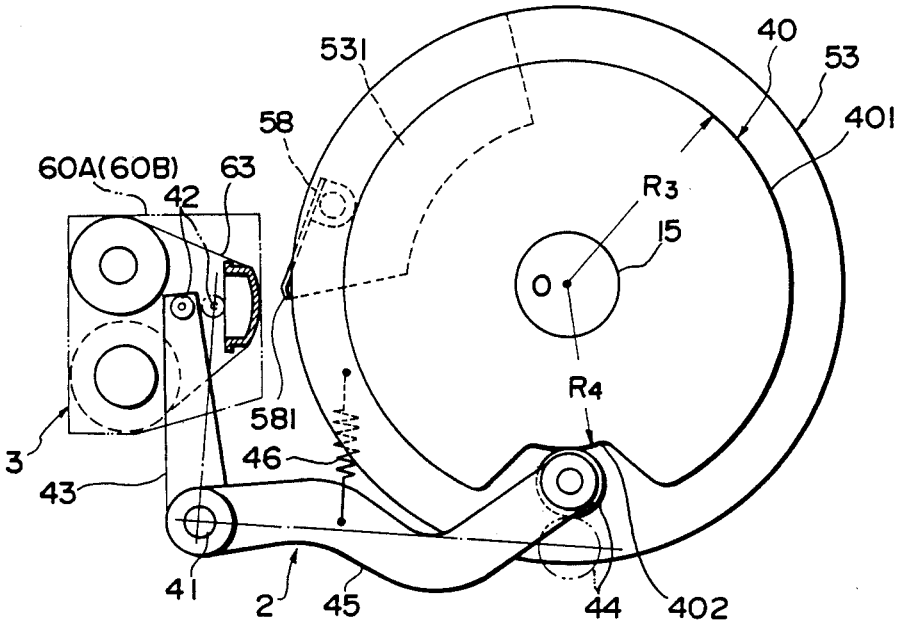
FIG. 10 is an illustration of the cleaner unit retracting mechanism in the third embodiment shown in FIG. 9.

FIGS. 9 and 10 show a third embodiment of the present invention in which a plate cam 40 serving as the projection detector is provided on the portion of the impression cylinder shaft 15 extending beyond the frame 4B. The plate cam 40 has a disk-like form with a crest 401 in the form of an arc of a radius $R_3$ centered at the point 0 and a valley 402 in the form of a arc of a radius $R_4$ and centered at the point 0. The cleaner unit retracting mechanism 2 in this embodiment includes a rocker shaft 41 which is rotatably carried by the frames 4A and 4B so as to extend in parallel with the axis of the impression cylinder 53, a first rocker link 43 pivotally connected to each side plate 60A, 60B through a pin 42, and a second rocker link 45 having a base end fixed to the portion of the rocker shaft 41 projecting outward from the frame 4B and rotatably carrying at its free end a cam follower 44. The cam follower 44 is normally biased into resilient contact with the plate cam 40 by a spring 46. The plate cam 40 has a valley 402 which is so positioned that it is brought into pressure contact with the cam follower 44 immediately before the ends 581 of the grippers 58 are brought to a position where they would interfere with the cleaner unit 3. In the period in which the cam follower 44 is held in pressure contact with the crest 401 of the plate cam 40 during the cleaning, the cleaner unit 3 is brought into contact with the impression cylinder 53 by the first pneumatic cylinders 8, whereby the surface of the impression cylinder 53 is cleaned. Immediately before the ends 581 of the grippers 58 are brought to positions where they would interfere with the cleaner unit 3, the cam follower 44 is retained by the valley 402 of the plate cam 40, whereby the cleaner unit 3 is retracted away from the surface of the impression cylinder 53. The plate cam 40 may be provided on the portion of the impression cylinder shaft 15 inside of the frame 4B as shown by an imaginary line in FIG. 9.

Figure 11:
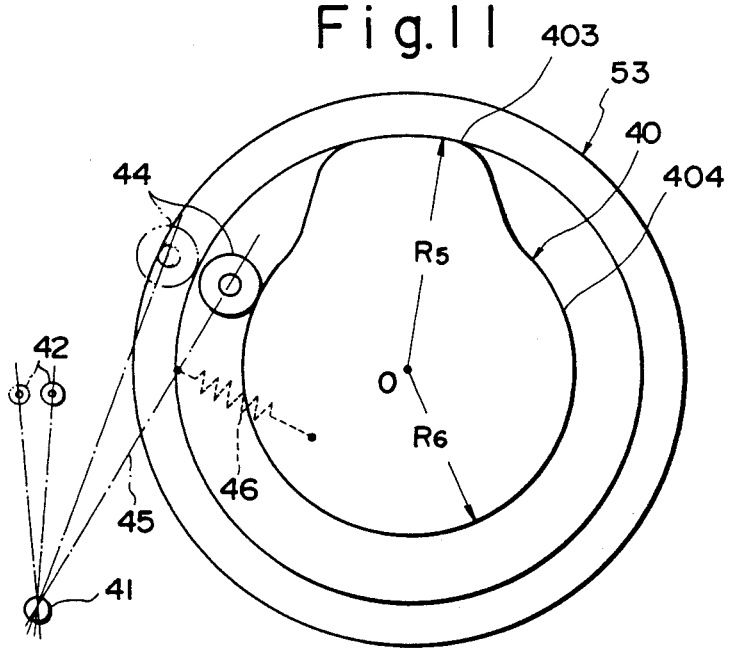
FIG. 11 is an illustration of a different example of the cleaner unit retracting mechanism used in the third embodiment.

FIG. 11 shows a modification of the third embodiment in which the plate cam 40 has a crest 403 in the form of an arc having a radius $R_5$ and centered at the point 0 and a valley 404 having a radius $R_6$ and also centered at the point 0. The cam follower 44 is normally pressed into pressure contact with the plate cam 40 by the force of a spring 46. The phase or position of the crest 403 of the plate cam 40 is so selected that it is brought into pressure contact with the cam follower 44 before the ends 581 of the grippers 58 are contacted by the cleaner unit 3. During the cleaning, when the cam follower 44 is held in pressure contact with the valley 404 of the plate cam 40, the cleaner unit 3 is held in contact with the peripheral surface of the impression cylinder 53 by the force produced by the first pneumatic cylinders 8, whereby the surface of the impression cylinder 53 is cleaned. However, when the ends 581 of the grippers 58 are brought to positions where they are going to contact the cleaner unit 3, the cam follower 44 rolls onto the crest 403 of the plate cam 40, whereby the cleaner unit 3 is moved away from the impression cylinder 53.

As has been described, according to the present invention, the possibility for the cleaner unit to be interfered with the projection on the surface of the impression cylinder is avoided, whereby the surface of the impression cylinder is cleaned while the impression cylinder rotates, whereby the cleaning efficiency is remarkably improved.

In a specific form of the invention, the retraction of the cleaner unit away from the outer peripheral surface of the cylinder is conducted without fail through the action of plate cams.

In another specific form of the invention, the retraction mechanism for retracting the cleaner unit from the outer peripheral surface of the cylinder includes a link mechanism which cooperates with the plate cams and which is composed of links. These links have a certain degree of freedom of locations, whereby a large degree of freedom of design is ensured without any risk for various parts of the machine to be interfered with one another.

What is claimed is:

1. An apparatus for cleaning an outer peripheral surface of a rotating cylinder provided with a projection through said outer peripheral surface comprising:

a cleaner unit located in the vicinity of said cylinder and adapted to be brought into and out of contact with said outer peripheral surface of said cylinder, said cleaner unit including a cloth supply roll and a cloth take-up roll having a cleaning cloth wound at both ends on and tensioned between said cloth supply roll and said cloth take up roll, a driving device to intermittently rotate said cloth take up roll, a pressure pad for pressing said cleaning cloth onto the surface of said rotating cylinder to clean the same with said cleaning cloth being disposed between said pressure pad and the surface of said cylinder, and a pair of guide members for retractably moving said cleaning unit into and out of contact with said outer peripheral surface of said cylinder, at least one cam plate mounted on said cylinder at one end thereof, said cam plate having a cam surface positioned so that its rotational phase corresponds to the rotational phase of the projection on said cylinder, and at least one cam follower attached to said cleaner unit adapted to cooperate with said plate cam and to retract said cleaner unit away from said cylinder when the projection on said cylinder is passing over said pressure pad.

2. An apparatus according to claim 1, wherein the cleaner unit includes actuator means for moving said cleaner unit away from the surface of the cylinder.

3. An apparatus according to claim 2, wherein the actuator means are electromagnetic actuators.

* * * * *